US011448220B2

(12) United States Patent
Borkowski et al.

(10) Patent No.: US 11,448,220 B2
(45) Date of Patent: Sep. 20, 2022

(54) AIREND HAVING A LUBRICANT FLOW VALVE AND CONTROLLER

(71) Applicant: INGERSOLL-RAND INDUSTRIAL U.S., INC., Davidson, NC (US)

(72) Inventors: Michael Borkowski, Concord, NC (US); Kelton C. Sprinkle, Statesville, NC (US); Michael O. Brewer, Cornelius, NC (US); Stephen Dickinson, Mooresville, NC (US); Ryan D. Hartman, Charlotte, NC (US); Daniel McGuinness, Charlotte, NC (US)

(73) Assignee: Ingersoll-Rand Industrial U.S., Inc., Davidson, NC (US)

( * ) Notice: Subject to any disclaimer, the term of this patent is extended or adjusted under 35 U.S.C. 154(b) by 168 days.

(21) Appl. No.: 16/586,107

(22) Filed: Sep. 27, 2019

(65) Prior Publication Data

US 2021/0095657 A1 Apr. 1, 2021

(51) Int. Cl.

| | |
|---|---|
| ***F04C 29/02*** | (2006.01) |
| ***F04B 39/02*** | (2006.01) |
| ***F04C 18/16*** | (2006.01) |
| ***F04C 29/00*** | (2006.01) |
| ***F04C 28/06*** | (2006.01) |

(Continued)

(52) U.S. Cl.

CPC ..... *F04C 29/021* (2013.01); *F04B 39/0207* (2013.01); *F04C 18/16* (2013.01); *F04C 23/008* (2013.01); *F04C 28/06* (2013.01); *F04C 29/0014* (2013.01); *F04C 29/02* (2013.01); *F04C 29/026* (2013.01); *F04C 29/042* (2013.01); *F04C 2240/50* (2013.01); *F04C 2240/52* (2013.01); *F04C 2240/809* (2013.01)

(58) Field of Classification Search

CPC ..... F04C 18/16; F04C 29/021; F04C 29/02; F04C 23/008; F04C 2240/52; F04C 28/06; F04C 29/026; F04C 2240/50; F04C 29/0007; F04C 29/0014; F04C 29/04; F04C 2210/14; F04C 29/042; F04C 2240/809; F04B 39/0207

See application file for complete search history.

(56) References Cited

U.S. PATENT DOCUMENTS 4,173,440 A * 11/1979 Libis ..... F04C 18/16 418/84

4,983,106 A * 1/1991 Wright ..... F04C 29/04 418/2

(Continued)

*Primary Examiner* — Peter J Bertheaud

(74) *Attorney, Agent, or Firm* — Kevin E. West; Advent, LLP

(57) ABSTRACT

A compressor system can include a lubricant injection system useful to supply lubricant to an airend. The compressor system can include a variable lubricant flow valve which can be regulated by a controller on the basis of operating conditions of the compressor system. In one form the compressor system also includes an oil separator and/or an oil cooler with or without a thermal control valve. The controller can have one or more modes of operation, including a mode in which the controller regulates the flow of lubricant to the airend to increase an internal flow area of the valve when the airend is operated at an unloaded or loaded condition. In some forms the controller can regulate the lubricant flow valve and/or the thermal control valve and/or the lubricant cooler.

20 Claims, 3 Drawing Sheets

(51) Int. Cl.
*F04C 29/04* (2006.01)
*F04C 23/00* (2006.01)

(56) References Cited

U.S. PATENT DOCUMENTS

| | | | | | |
|---|---|---|---|---|---|
| 5,469,713 | A * | 11/1995 | Wardle | F04C 29/02 | 62/193 |
| 5,634,345 | A | 6/1997 | Alsenz | | |
| 5,957,676 | A * | 9/1999 | Peeters | C10M 171/008 | 418/1 |
| 8,123,493 | B2 * | 2/2012 | Yoshimura | F01C 21/04 | 417/228 |
| 8,454,334 | B2 * | 6/2013 | Heger | F04C 29/021 | 418/84 |
| 8,858,192 | B2 | 10/2014 | Shikano et al. | | |
| 8,870,555 | B2 * | 10/2014 | Feller | F04C 29/042 | 418/84 |
| 9,568,001 | B2 * | 2/2017 | Endo | F04C 18/16 | |
| 10,288,070 | B2 * | 5/2019 | Akei | F04C 18/16 | |
| 2012/0003113 | A1 | 1/2012 | Shikano et al. | | |
| 2013/0156612 | A1 | 6/2013 | Bonnefoi et al. | | |
| 2018/0119600 | A1 | 5/2018 | Lu et al. | | |
| 2018/0238329 | A1 * | 8/2018 | Kasahara | F04C 18/16 | |

* cited by examiner

AIREND HAVING A LUBRICANT FLOW VALVE AND CONTROLLER

TECHNICAL FIELD

The present invention generally relates to lubricant delivery to an airend, and more particularly, but not exclusively, to regulation of lubricant to an airend.

BACKGROUND

Providing lubricant to an airend across a range of operating conditions remains an area of interest. Some existing systems have various shortcomings relative to certain applications. Accordingly, there remains a need for further contributions in this area of technology.

SUMMARY

One embodiment of the present invention is a unique compressor system having a controller and lubricant flow valve. Other embodiments include apparatuses, systems, devices, hardware, methods, and combinations for regulating a control valve through which a flow of lubricant is provided to an airend. Further embodiments, forms, features, aspects, benefits, and advantages of the present application shall become apparent from the description and figures provided herewith.

DETAILED DESCRIPTION OF THE ILLUSTRATIVE EMBODIMENTS

Figure 1:
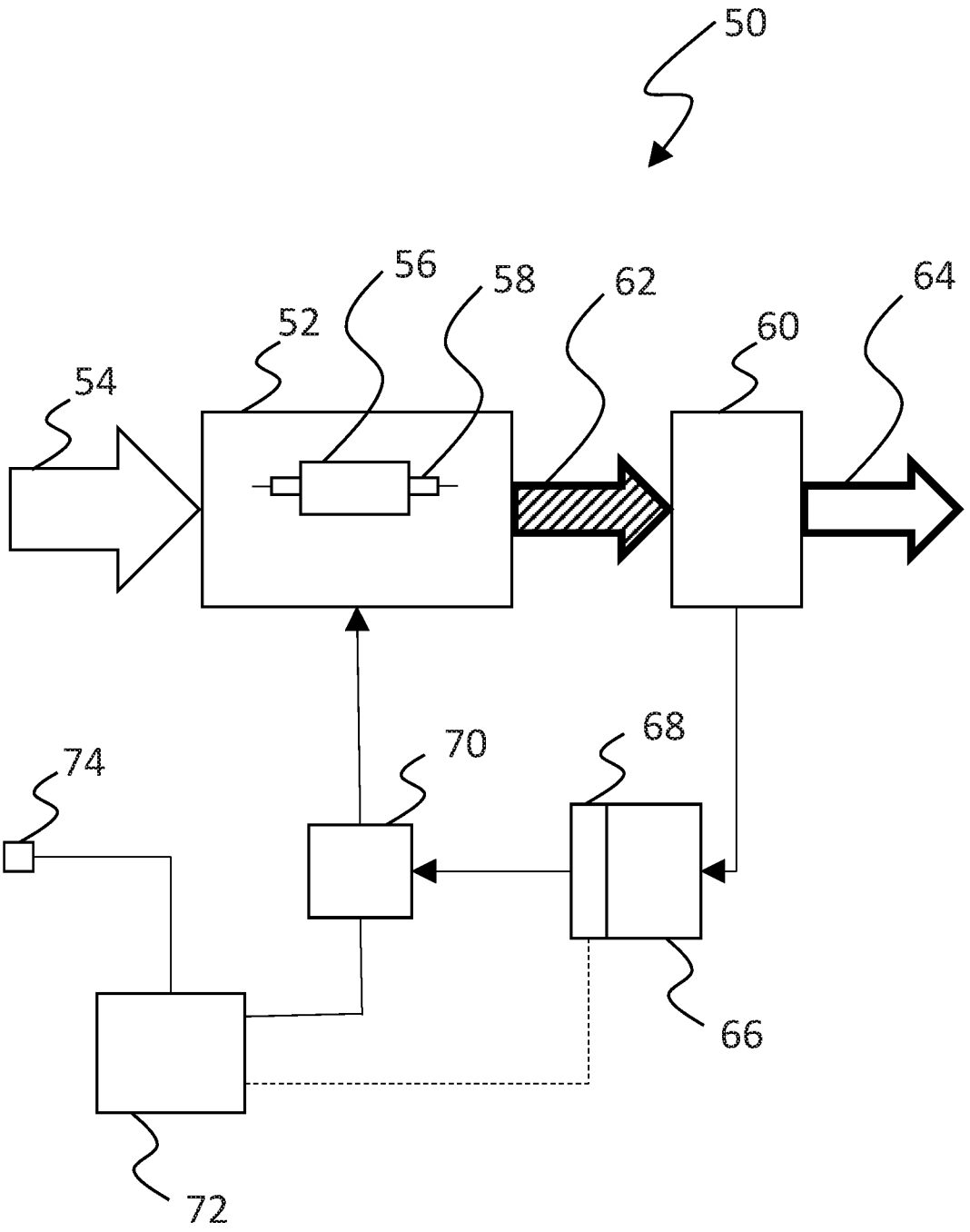
FIG. 1 depicts an embodiment of a compressor system.

For the purposes of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

With reference to FIG. 1, a compressor system 50 is disclosed which includes an airend 52 configured to compress an incoming flow of fluid 54. The fluid can be air, but other compressible fluids are also contemplated herein. The airend 52 can take on any variety of compressor types, and in general will include a movable mechanical component 56 structured to compress the fluid 54 which is supported by at least one bearing 58. The bearing 58 can take any variety of forms such as thrust or radial bearings. In this regard the bearing can be a plain bearing, fluid bearing, rolling element bearing (e.g. ball bearing, cylindrical roller bearing, tapered roller bearing), tilting pad bearing, etc. The airend 52 can take on any variety of compressor forms, and in one non-limiting embodiment is a screw compressor in which the movable mechanical component 56 is a screw rotor. In the form of a screw rotor the airend 52 can be a dry type compressor, but in other forms the screw rotor can be a contact cooled compressor which can use any suitable form of cooling/lubricating/sealing fluid such as but not limited to oil.

In the form of a contact cooled airend 52 the compressor system 50 can include an air/lubricant separator 60 useful to separate lubricant used in the compression process after it becomes entrained in a mixed flow 62 of compressed fluid and lubricant (also referred to as a discharge flow). If the compressor system 50 is a dry type compressor, the flow 62 may not include residual lubricant used in the bearings 58 in which case a separator may not be needed. The air/lubricant separator 60 can take a variety of forms including separator tanks with baffles, centrifugal separators, separators having a physical media, etc and any combination of the same. The air/lubricant separator produces a relatively clean flow of compressed fluid 64 for use by a downstream customer of the compressor system 50. The downstream user can be an industrial process, facility air, etc.

The air/lubricant separator 60 produces a stream of lubricant that can be delivered to a lubricant cooler 66 useful to cool the lubricant prior to further use with the compressor system 50. Although not illustrated, in some forms a lubricant sump can be used to collect lubricant as it is returned from its various consumers (main injection, bearings, etc). In the case of a dry type airend 52, the lubricant cooler 66 can, but need not be present prior to recycling the lubricant back to the compressor 50. The lubricant cooler 66 can take a variety of forms including an air/lubricant cooler, a refrigerant based cooler, etc.

Some embodiments may also include a thermal control valve 68 that operates with the lubricant cooler 66 and is useful to regulate a temperature of the lubricant to be delivered back to the compressor. The thermal control valve 68 can be integrated with the lubricant cooler 66, or can be a standalone device, and can be operated using any variety of techniques both passive and active. For example, the thermal control valve 68 can be a passive valve that is actuated based upon any number of sensed conditions such as a compressor discharge temperature, lubricant temperature, etc. Such passive valves will be understood to include valve types that react to a change in temperature (e.g. bimetallic valves, wax motors, etc). In some forms the thermal control valve 68 can be controlled by a controller (such as the controller 72 discussed further below) that relies upon one or more sensed feedback parameters to regulate the temperature of the lubricant. Not all embodiments need be regulated by a controller as is indicated by the dotted line in FIG. 1. The thermal control valve can take a variety of forms similar to the lubricant control valve 70 described further below (e.g. the type (electrically driven, pneumatic, etc), construction (e.g. spool valve, etc), and number of possible valve positions (e.g. two or more, discrete or continuous, etc)). As will be appreciated given the discussion above, the thermal control valve 68 need not be present if the lubricant cooler 66 is also absent. In some embodiments, such as dry type airends, a lubricant cooler 66 can still be present to cool lubricant used with the bearings.

A lubricant flow valve 70 is used in the instant application to control flow of lubricant to the mechanical components of the compressor system 50 that consume lubricant, such as but not limited to the bearings. Although the lubricant flow valve 70 can take a variety of forms, in at least one embodiment the valve 70 includes at least two operating positions, but other number of positions are contemplated. The two positions correspond to a first open position and a second open position in which lubricant is permitted to traverse through the lubricant control valve 70. The first open position is relatively more open than the second open position, and thus permits a greater flow of lubricant through the flow valve 70. The size of the passage created by the control valve 70 in the first open position is useful to provide a flow of lubricant therethrough, where the magnitude of such flow can be characterized by its velocity. As used herein, the velocity of the fluid can be expressed as a mass flow rate, a volumetric flow rate, or a speed of the lubricant (e.g. an injection speed, aggregate speed, average speed, core speed, etc) through the control valve 70. Likewise, the size of the passage created by the control valve in the second open position is useful to provide a velocity of lubricant therethrough. In some forms the lubricant control valve 70 includes discrete positions with transition movements required between the discrete positions. Any number of discrete positions are contemplated and are not limited to the first open position and second open position. In this way the valve can include a third open position as well as any number of other open positions. The third position can correspond to an open position relatively more closed than the second position, but need not. In other forms the valve can be continuously varied between an upper limit and a lower limit with a range of possible positions in between the two limits. The first open position and second open position can correspond to such limits of the valve in this example. Additionally to the above, any of the positions of the valve 70 can correspond to a closed position in which a flow of lubricant is effectively zero. Using one of the embodiments described above, the first and second open positions can be supplemented with a closed position so that the valve 70 can transition during operation between the first and second open positions, and when the compressor is shut down the valve 70 can be set to the closed position.

The lubricant flow valve 70 can have any variety of construction useful to vary the flow of lubricant through the valve. Such constructions include, but are not limited to, a needle valve, slide valve, spool valve, and ball valve. The lubricant flow valve 70 can be actuated to its various positions via any suitable technique. Examples of such valves 70 include electrically driven valves, hydraulic valves, pneumatic valves, and electromechanical valves.

Any number of lubricant flow valves 70 can be used to deliver lubricant to any lubricant consuming component such as the one or more bearings 58. In the embodiment in which the airend 52 is contact cooled, existing valves 70 used to deliver lubricant to the bearings 58 can also be used to deliver lubricant to the screw rotors 52, but additional valves 70 can also be used for that dedicated purpose. Any variety of conduit configurations useful to deliver lubricant to the one or more valves 70 is contemplated. For example, Y-splitter connections can be used to split a line to two separate valves 70, each capable of operating to regulate the flow of lubricant to separate locations/devices of the compressor system 50. In additional and/or alternative forms, the Y-splitter can be placed downstream of the valve 70. In some embodiments a plenum can be used where appropriate to collect lubricant prior to injection. Such a plenum can be used either upstream or downstream of the valve 70.

The lubricant flow valve 70 can provide lubricant to any number of injection points. The injection points can include at the bearings 58 and/or at the screw rotors 52, among other potential locations. Lubricant can be delivered directly to the bearings 58, or indirectly such as might occur through seepage to the bearings after main injection to the screw rotors. To set forth just a few non-limiting examples, the lubricant flow valve 70 can regulate the flow of lubricant to a ball bearing, such as at the inner race of the ball bearing, to the rolling elements of the bearing, and/or to the outer race of the ball bearing, including any combination of these. In the case of a rotor supported at opposing ends by separate bearings, the lubricant can be regulated to each of the separate bearings by the valve 70 such that it is delivered serially or in parallel (such as but not limited through use of a splitter or a plenum). The delivery of lubricant can be by any useful technique such as splash lubrication, spray lubrication, pressure lubrication, etc. Lubricant can also be regulated by the valve 70 to be delivered to the airend 52 in case of a contact cooled airend 52. Such delivery can occur at any suitable location associated with the contact cooled airend 52.

The compressor system 50 also includes a controller 72 useful to regulate operation of the lubricant flow valves 70 to any of the possible positions described above. The controller 72 can be comprised of digital circuitry, analog circuitry, or a hybrid combination of both of these types. Also, the controller 72 can be programmable, an integrated state machine, or a hybrid combination thereof. The controller 72 can include one or more Arithmetic Logic Units (ALUs), Central Processing Units (CPUs), memories, limiters, conditioners, filters, format converters, or the like which are not shown to preserve clarity. In one form, the controller 72 is of a programmable variety that executes algorithms and processes data in accordance with operating logic that is defined by programming instructions (such as software or firmware). Alternatively or additionally, operating logic for the controller 72 can be at least partially defined by hardwired logic or other hardware.

The controller 72 can be structured to receive data from one or more sensors 74 associated with the compressor system 50. Such a sensor 74 can be suitable to sense or estimate conditions such as a pressure or temperature of the compressor system 50, or any other useful condition (e.g. speed of rotor, time, strain, vibration, etc). In this manner, the sensor can be a separate device such as a pressure transducer or thermocouple, or it can effectively be a routine calculated by the controller to estimate a condition. In the case of time as a control parameter, such time value can be intrinsic with certain embodiments of the controller 72, and in this manner can be considered as sensed from a processor that implements the controller. Any number of sensors 74 can be used. The controller 72 can operate on the basis of the sensed/estimated values from the sensor 74 to regulate position of the lubricant flow valve 70. To set forth just a few examples, the controller 72 can activate the lubricant control valve 70 on the basis of control parameters such as temperature and/or pressure of the inlet air to the airend 52, temperature and/or pressure of an outlet of the airend 52, temperature and/or pressure of the lubricant, etc. More specifically, in some forms the controller 72 can activate the lubricant control valve 70 on the basis of discharge pressure, discharge temperature, oil injection temperature, ambient conditions, and/or rotor speed. The controller 72 can alternatively and/or additionally activate the lubricant control valve 70 on the basis of an operational state of the airend. In some embodiments the control valve 70 can be activated by the controller 72 using one, or more than one, of the sensed/estimated parameters.

The controller 72 can activate the lubricant control valve 70 to any of the available positions using a variety of techniques, including any of an open loop control scheme, closed loop control scheme, and blended control schemes, to set forth just a few non-limiting examples. In one form the control system can operate to control flow of lubricant using a relationship between input/output, which can be implemented as a table lookup or perhaps a formulaic equation, to set forth just a few nonlimiting examples. The input/output relationship operates on receipt of a control input parameter (e.g. sensed temperature) to determine a control output for the valve 70. For example, such a control system can use as a control input a temperature of lubricant, which then outputs a command to the control valve 70, such a voltage command if the control valve is electrically actuated, or any other type of command suitable to the various types of actuated valves described herein. In other forms the simple lookup can use any other temperature or pressure related to the compressor system 50, or related to the environment in which the compressor system 50 is operating, as an input. Such other temperatures and pressure can include, but are not limited to, compressed air temperature or pressure, lubricant pressure, etc. The exact form of the table lookup can take any shape, including but not limited to a linear relationship, a staggered or stepped relationship, piecewise linear, curvilinear, logarithmic, etc. The table lookup or the formulaic equation can rely upon one or more input parameters. For example, the table lookup can be a three dimensional table, or the formulaic equation can be multi-variate, to set forth just a few nonlimiting examples. In short, any type of relationship using any suitable input variable(s) can be utilized to determine a control output value for the lubricant control valve 70. The control output value from the input/output relationship can take any variety of forms depending on the nature of the system. To set forth just a few nonlimiting examples, the control output value can be a command to the valve (e.g. excitation voltage), or it can be a command closely tied to a specific valve position if the valve is calibrated, or determine a valve command if the valve is controlled in a closed loop manner, or to determine a flow of lubricant through the valve.

In those embodiments where the controller 72 operates at least partially by closing a loop using feedback control, the controller 72 can operate to control flow of lubricant through the valve 70 by regulating any number of variables. For example, the controller 72 can be operated by regulating a sensed parameter, regulating a synthesized variable that represents the combination of several different parameters, etc. In one form the control system utilizes a first routine which determines a desired velocity of lubricant (e.g. based upon operating condition of the compressor), and then regulates the lubricant control valve 70 based upon the desired velocity of lubricant. Such regulation can be accomplished by sensing or estimating velocity of the lubricant ("actual velocity"), and then comparing the actual velocity to the desired velocity, opening the valve to increase the actual to match desired, and closing the valve to decrease the actual to match desired.

The control system can implement any useful type of control algorithm using any type of control architecture. For example, the control regulation can be accomplished using a proportional-integral-derivative (PID) control scheme. In other forms the controller 72 can use modern control theory, robust control theory, fuzzy logic, and/or machine learning/artificial intelligence, to set forth just a few nonlimiting examples.

To set forth just a few operational examples, the controller 72 can operate the lubricant control valve 70 in one mode of operation to have its flow area altered (in one nonlimiting form it is increased) when it senses a reduction in temperature of the lubricant. Such altered flow area may be required to counter the effects of increased viscosity associated with a decrease in temperature of the lubricant. In some forms, for main injection into the rotors as temperature of the oil changes the flow area of the valve 70 is also altered.

In another additional and/or alternative modes of operation, such as an unloaded condition of the airend 52, the controller 72 can be operated to increase the area of the valve 70 to increase the ability of lubricant to be delivered through the valve 70 which should permit operation of the airend 52 at lower allowable turndown than would be possible in a system that lacks a variable valve 70. For example, the flow passage in the valve 70 through which lubricant passes on its way to the bearings 58 can be relatively increased when transitioning to an unloaded state to encourage flow of lubricant to the bearings, while a passage in another valve 70 through which lubricant passes on its way to a contact cooled rotor 56 can be decreased when transitioning to the unloaded state to lower the consumption of lubricant to the rotor 56 in that state.

Another additional and/or alternative operational mode includes maintaining an ideal temperature rise across a range of operating conditions (which may be dependent upon speed of rotors or discharge pressure), including but not limited to from unloaded to loaded. Regulation by the controller 72 of the valve 68 (and also possibly valve 70) can lead to more consistent temperature rise across the airend 52 while maintaining adequate delivery of lubricant through the valve 70.

In still another additional and/or alternative operational mode, the controller 72 can regulate the valve 70 as a function of speed of the rotor and/or a function of pressure of the airend outlet (or possibly pressure of lubricant).

In still another additional and/or alternative operational mode, lubricant supplied to the bearing 58 can be provided through a valve 70 that varies independent of lubricant being supplied to the rotor in a contact cooled airend 52.

In still another additional and/or alternative operational mode, the various embodiments described herein can be operated to optimize efficiency of the system, whether it is to regulate operation of the lubricant cooler, thermal control valve, and/or lubricant control valve. One or more operational conditions or states of the compressor can be used to formulate a command to any one or more of the lubricant cooler, thermal control valve, and/or lubricant control valve. For example, any one or more of discharge pressure, discharge temperature, oil injection temperature, ambient conditions, and rotor speed can be used in the regulation to optimize efficiency.

As will be appreciated, the controller 72 can implement any one or more of the operational modes described herein.

In those embodiments having multiple valves 70, each of the valves 70 can be operated separately using different techniques described above, or can all be operated in unison with the same commands.

As will be appreciated in the description above, the controller 72 can regulate operation of the valve 70 to deliver variable flow to lubricant consuming components of the compressor system 50 across a variety of conditions, or to ensure a constant flow to lubricant consuming components. As understood by those of skill in the art, the variety of conditions that the compressor 50 may experience includes environmental conditions such as ambient temperature, humidity, and pressure, as well as internal conditions such as airend outlet pressure, lubricant temperature, lubricant pressure, etc. In those forms in which the airend 52 is contact cooled, the controller 72 can control the thermal control valve 68 as well as the lubricant flow valve 70 to regulate lubricant delivery within the compressor system 50.

In another form where the lubricant cooler 66 can also be controlled to modulate heat transfer (e.g. modulating fan airflow in an air/lubricant cooler 66 to effect heat transfer), it may also be possible to regulate not only the valve 68, but also the valve 70 and/or the cooler 66 to maintain a desired temperature rise across the airend 52 while maintaining adequate delivery of lubricant through the valve 70.

Although the embodiment depicted in FIG. 1 includes just a single airend 52, other forms can include additional airends 52 to form any number of compressor stages. It will be appreciated that lubricant can be delivered using the same valve 70 to the various stages, and in some forms separate valves 70 can be used for each of the multiple stages. Lubricant can be delivered to one or more bearings of one or more of the stages, and/or one or more of the rotors of each stage using the techniques described above.

Figure 2:
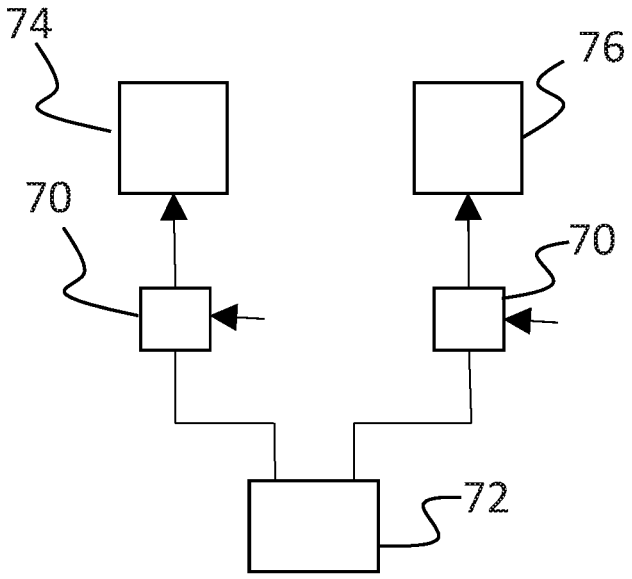
FIG. 2 depicts an arrangement of select components of a compressor system.

Turning now to FIG. 2, one configuration is disclosed showing the controller 72 operating to regulate two different valves 70 which deliver lubricant to separate components of the airend 52. The components can include bearings 58 associated with two separate airends 52 (such as a first stage and a second stage). Alternatively, the components can include at least one bearing 58 of the airend 52 and the rotor in the case of a contact cooled airend 52.

Figure 3:
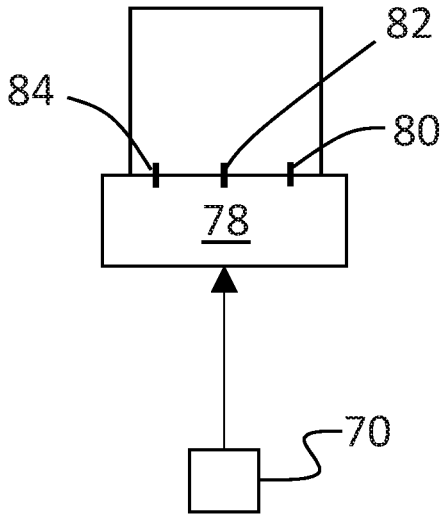
FIG. 3 depicts an arrangement of select components of a compressor system.

FIG. 3 illustrates an example of a valve 70 useful to deliver lubricant to a plenum 78 which feeds separate injection sites 80, 82, and 84. The plenum can be any size and shape and is structured as a gallery useful to receive a volume of lubricant which can be used to collectively feed the injection sites.

Figure 4:
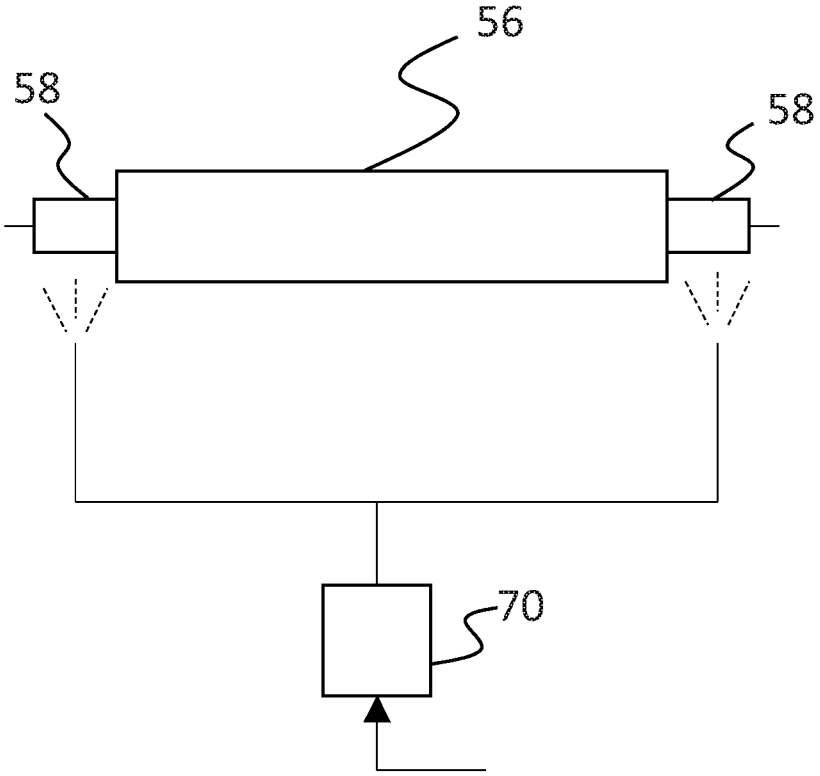
FIG. 4 depicts an arrangement of select components of a compressor system.

FIG. 4 illustrates an example of a valve 70 configured to supply lubricant to bearings 58 of the airend 52. As illustrated, the valve 70 delivers lubricant to bearings 58 at opposite ends of the airend 52 after the lubricant has been split. In some forms separate valves 70 can be used in lieu of a single valve and splitter. The lubricant is illustrated as being sprayed on the bearings 58, but other types of lubricant injection are also contemplated as described herein.

One aspect of the present application includes an apparatus comprising an airend having a male screw rotor configured to be complementarily rotated with a female screw rotor, a plurality of rolling element bearings structured to rotatingly support the male screw rotor and the female screw rotor when they are rotated to provide a flow of compressed fluid, a lubricant circuit having a conduit configured for the passage of a lubricant, the conduit configured to deliver lubricant to the plurality of rolling element bearings, a control valve in fluid communication with the conduit and structured to regulate a flow of lubricant through the conduit to the plurality of rolling element bearings, the control valve having a first position structured to deliver a first flow of lubricant to the plurality of rolling element bearings and a second position structured to deliver a second flow of lubricant to the plurality of rolling element bearings, the first flow greater than the second flow, and a controller configured to regulate the flow of lubricant through the control valve by activating the control valve to transition from the first position to the second position as a function of the operational state of the airend.

A feature of the present application includes wherein the controller activates the control valve as a function of the operational state of the airend including discharge pressure of the airend.

Another feature of the present application includes wherein the controller is structured to regulate a velocity of the lubricant delivered to the plurality of rolling element bearings from the control valve.

Yet another feature of the present application includes wherein the airend is a contact cooled compressor, wherein the conduit includes a plurality of conduits, and wherein the plurality of conduits provide lubricant to the plurality of rolling element bearings and to at least one of the male screw rotor and female screw rotor for purposes of lubrication, cooling, and sealing of the male screw rotor and female screw rotor during a compression process.

Still another feature of the present application further includes an oil cooler structured to transfer heat from the lubricant after the lubricant has been used to lubricate the plurality of bearings and after it has been used by the male screw rotor and the female screw rotor.

Yet still another feature of the present application includes wherein the controller is further structured to regulate a thermal control valve in communication with the oil cooler, the thermal control valve structured to regulate a temperature of lubricant delivered to the plurality of bearings, and wherein the regulation of the flow of lubricant through the control valve by the controller is based upon temperature of the lubricant.

Still yet another feature of the present application includes wherein the airend includes a first stage compressor and a second stage compressor, the first stage compressor having the male screw rotor and the female screw rotor, the second stage compressor having a second male screw rotor and a second female screw rotor, wherein the conduit includes a plurality of conduits, wherein the plurality of rolling element bearings are structured to rotatingly support the male screw rotor, the female screw rotor, the second male screw rotor, and the second female screw rotor.

A further feature of the present application includes wherein the airend is a contact cooled compressor, wherein the conduit includes a plurality of conduits, and wherein the plurality of conduits provide lubricant to at least one of the plurality of rolling element bearings and to at least one of the first stage compressor and second stage compressor useful to provide lubrication, cooling, and sealing of the contact cooled compressor process.

A still further feature of the present application includes wherein the control valve includes a plurality of control valves, and wherein lubricant can be delivered to the first stage independent of delivery of lubricant to the second stage.

A yet further feature of the present application includes wherein the conduit is configured to deliver lubricant directly to the rolling element bearings, and wherein the controller activates the control valve as a function of the operational state of the airend including discharge temperature of the airend.

A still yet further feature of the present application includes wherein the controller activates the control valve as a function of the operational state of the airend including at least one of oil injection temperature, ambient condition, and a speed of the male and female screw rotors.

Another aspect of the present application includes an apparatus comprising an airend having a rotating mechanical component configured to compress a working fluid, a bearing structured to support the rotating mechanical component, a lubrication system including a passage structured to convey lubricant, the lubrication system structured to lubricate the bearing and the rotating mechanical component to provide cooling and lubrication, a lubricant flow valve in fluid communication with the passage and structured to regulate flow of lubricant through the passage to the plurality of bearings and the rotating mechanical component, the lubricant flow valve having first open position and a second open position, the first open position structured to deliver a flow of lubricant greater than a flow of lubricant associated with the second open position, and a controller configured to regulate the flow of lubricant through the control valve by activating the control valve to transition from the first position to the second position as a function of the operational state of the airend.

A feature of the present application includes wherein the first open position is associated with a loaded condition of the airend, and the second position is associated with an unloaded condition of the airend, and wherein the controller is structured to regulate flow of lubricant through the control valve on the basis of the operational state of the airend including discharge pressure of the airend.

Another feature of the present application includes wherein the airend is a contact cooled screw compressor, and wherein the rotating mechanical component includes a plurality of rotating mechanical components, and wherein the plurality of rotating mechanical components includes a first screw rotor and the second screw rotor.

Yet another feature of the present application includes wherein the control valve includes a plurality of control valves, wherein one of the plurality of control valves provides lubricant to the bearing, and wherein another of the plurality of control valves provides lubricant to the rotating mechanical component.

Still another feature of the present application further includes a lubricant cooler structured to cool lubricant after it has been used to lubricate the bearing.

Yet still another feature of the present application further includes a thermal control valve structured to regulate temperature of the lubricant prior to being delivered to the lubricant control valve.

Still yet another feature of the present application includes wherein the lubricant flow valve also includes a closed position associated with no flow of lubricant through the lubricant flow valve, and wherein the lubricant flow valve is structured to have a plurality of positions between the closed position and the first open position.

A further feature of the present application includes wherein the controller includes at least one of the following: (1) a table lookup configured to relate the operational state of the airend to a velocity of lubricant; and (2) a control system element configured to reject steady state error in a commanded flow rate of lubricant.

A still further feature of the present application includes wherein the airend is a contact cooled screw compressor, wherein the controller is structured to regulate flow of lubricant through the control valve on the basis of at least one of a pressure of the airend and a speed of the first and second screw rotors, wherein the controller includes an input/output relationship between desired flow rate and valve position, and which further includes a lubricant cooler and a thermal control valve, lubricant cooler structured to cool lubricant after it has been used to lubricate the bearing, and the thermal control valve structured to regulate temperature of the lubricant prior to being delivered to the lubricant control valve.

A yet still further feature of the present application includes wherein the controller is structured to regulate flow of lubricant through the control valve on the basis of the operational state of the airend including discharge temperature of the airend.

A still yet further feature of the present application includes wherein the controller is structured to regulate flow of lubricant through the control valve on the basis of the operational state of the airend including at least one of oil injection temperature, ambient conditions, and rotor speed of the rotating mechanical component.

Yet another aspect of the present application includes a method comprising operating an airend at a first compressor operation point corresponding to a loaded condition, changing operation of the airend from the loaded condition to an unloaded condition, sensing one of a temperature or a pressure associated with compressor operation, calculating a lubricant control valve position dependent upon an operational condition of the compressor operation, as a result of the calculating, altering a lubricant control valve to provide lubricant to a bearing of the airend in the unloaded condition.

A feature of the present application includes further includes regulating a thermal control valve through which lubricant flows prior to being received in the lubricant control valve.

Another feature of the present application includes wherein the temperature is a temperature of the lubricant, wherein the opening includes increasing a flow area of the lubricant control valve with a decrease in temperature of the lubricant.

Yet another feature of the present application further includes reducing a flow area of the lubricant control valve when operation of the airend returns from the unloaded condition to the loaded condition, wherein the airend is a contact cooled airend, and which further includes regulating a flow of lubricant to at least one of a male and female rotor of the airend.

Still another feature of the present application further includes increasing a flow area of the lubricant control valve when operation of the airend changes between the unloaded condition and the loaded condition.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

What is claimed is:

1. An apparatus comprising:

an airend including a first stage compressor and a second stage compressor, the airend having a male screw rotor configured to be complementarily rotated with a female screw rotor;

a plurality of rolling element bearings configured to rotatingly support the male screw rotor and the female screw rotor when they are rotated to provide a flow of compressed fluid;

a lubricant circuit having a conduit configured for the passage of a lubricant, the conduit configured to deliver lubricant to the plurality of rolling element bearings;

a control valve in fluid communication with the conduit and configured to regulate a flow of lubricant through the conduit to the plurality of rolling element bearings, the control valve having a first position configured to deliver a first flow of lubricant to the plurality of rolling element bearings and a second position configured to deliver a second flow of lubricant to the plurality of rolling element bearings, the first flow greater than the second flow, wherein lubricant can be delivered to the first stage independent of delivery of lubricant to the second stage; and a controller configured to regulate the flow of lubricant through the control valve by activating the control valve to transition from the first position to the second position as a function of the operational state of the airend.

2. The apparatus of claim 1, wherein the controller activates the control valve as a function of the operational state of the airend including discharge pressure of the airend.

3. The apparatus of claim 2, wherein the controller is configured to regulate a velocity of the lubricant delivered to the plurality of rolling element bearings from the control valve.

4. The apparatus of claim 3, wherein the airend is a contact cooled compressor, wherein the conduit includes a plurality of conduits, and wherein the plurality of conduits provide lubricant to the plurality of rolling element bearings and to at least one of the male screw rotor and female screw rotor for purposes of lubrication, cooling, and sealing of the male screw rotor and female screw rotor during a compression process.

5. The apparatus of claim 4, which further includes an oil cooler configured to transfer heat from the lubricant after the lubricant has been used to lubricate the plurality of bearings and after it has been used by the male screw rotor and the female screw rotor.

6. The apparatus of claim 5, wherein the controller is further configured to regulate a thermal control valve in communication with the oil cooler, the thermal control valve configured to regulate a temperature of lubricant delivered to the plurality of bearings, and wherein the regulation of the flow of lubricant through the control valve by the controller is based upon temperature of the lubricant.

7. The apparatus of claim 3, the first stage compressor having the male screw rotor and the female screw rotor, the second stage compressor having a second male screw rotor and a second female screw rotor, wherein the conduit includes a plurality of conduits, wherein the plurality of rolling element bearings are configured to rotatingly support the male screw rotor, the female screw rotor, the second male screw rotor, and the second female screw rotor.

8. The apparatus of claim 7, wherein the airend is a contact cooled compressor, wherein the conduit includes the plurality of conduits, and wherein the plurality of conduits provide lubricant to at least one of the plurality of rolling element bearings and to at least one of the first stage compressor and second stage compressor useful to provide lubrication, cooling, and sealing of a contact cooled compressor process.

9. The apparatus of claim 7, wherein the control valve includes a plurality of control valves.

10. The apparatus of claim 1, wherein the conduit is configured to deliver lubricant directly to the rolling element bearings, and wherein the controller activates the control valve as a function of the operational state of the airend including discharge temperature of the airend.

11. The apparatus of claim 1, wherein the controller activates the control valve as a function of the operational state of the airend including at least one of oil injection temperature, ambient condition, and a speed of the male and female screw rotors.

12. An apparatus comprising:

an airend having a rotating mechanical component configured to compress a working fluid;

a bearing configured to support the rotating mechanical component;

a lubrication system including a passage configured to convey lubricant, the lubrication system configured to lubricate the bearing and the rotating mechanical component to provide cooling and lubrication;

a lubricant flow valve in fluid communication with the passage and configured to regulate flow of lubricant through the passage to a plurality of bearings and the rotating mechanical component, the lubricant flow valve having first open position and a second open position, the first open position configured to deliver a flow of lubricant greater than a flow of lubricant associated with the second open position, wherein the first open position is associated with a loaded condition of the airend, and the second position is associated with an unloaded condition of the airend;

a controller configured to regulate the flow of lubricant through the lubricant flow valve by activating the lubricant flow valve to transition from the first position to the second position as a function of the operational state of the airend, wherein the controller is configured to regulate flow of lubricant through the lubricant flow valve on the basis of the operational state of the airend including discharge pressure of the airend; and a thermal control valve configured to regulate temperature of the lubricant prior to being delivered to the lubricant control valve.

13. The apparatus of claim 12, wherein the airend is a contact cooled screw compressor, and wherein the rotating mechanical component includes a plurality of rotating mechanical components, and wherein the plurality of rotating mechanical components includes a first screw rotor and the second screw rotor.

14. The apparatus of claim 12, wherein the lubricant flow valve includes a plurality of control valves, wherein one of the plurality of control valves provides lubricant to the bearing, and wherein another of the plurality of control valves provides lubricant to the rotating mechanical component.

15. The apparatus of claim 12, which further includes a lubricant cooler configured to cool lubricant after it has been used to lubricate the bearing.

16. The apparatus of claim 15, wherein the lubricant flow valve also includes a closed position associated with no flow of lubricant through the lubricant flow valve, and wherein the lubricant flow valve is configured to have a plurality of positions between the closed position and the first open position.

17. The apparatus of claim 12, wherein the controller includes at least one of the following: a table lookup configured to relate the operational state of the airend to a velocity of lubricant; and a control system element configured to reject steady state error in a commanded flow rate of lubricant.

18. The apparatus of claim 17, wherein the airend is a contact cooled screw compressor, wherein the controller is configured to regulate flow of lubricant through the control valve on the basis of at least one of a pressure of the airend and a speed of the first and second screw rotors, wherein the controller includes an input/output relationship between desired flow rate and valve position, and which further includes a lubricant cooler and a thermal control valve, lubricant cooler configured to cool lubricant after it has been used to lubricate the bearing, and the thermal control valve configured to regulate temperature of the lubricant prior to being delivered to the lubricant flow valve.

19. The apparatus of claim 12, wherein the controller is configured to regulate flow of lubricant through the control valve on the basis of the operational state of the airend including discharge temperature of the airend.

20. The apparatus of claim 12, wherein the controller is configured to regulate flow of lubricant through the control valve on the basis of the operational state of the airend including at least one of oil injection temperature, ambient conditions, and rotor speed of the rotating mechanical component.

* * * * *